US006375058B1

(12) United States Patent
Passamoni

(10) Patent No.: US 6,375,058 B1
(45) Date of Patent: Apr. 23, 2002

(54) PAPERBOARD DISPENSER CARTON WITH PLASTIC CUTTING BLADE ON CARTON BODY

(75) Inventor: Phillip L. Passamoni, Green Bay, WI (US)

(73) Assignee: Green Bay Packaging, Inc., Green Bay, WI (US)

( * ) Notice: Subject to any disclaimer, the term of this patent is extended or adjusted under 35 U.S.C. 154(b) by 0 days.

(21) Appl. No.: 09/539,003

(22) Filed: Mar. 30, 2000

(51) Int. Cl.[7] ..... B26D 1/02

(52) U.S. Cl. ..... 225/49; 225/39; 225/43; 225/77

(58) Field of Search ..... 225/38, 37, 34, 225/36, 46, 48, 49, 43, 91, 77, 39

(56) References Cited

U.S. PATENT DOCUMENTS

| | | | | | |
|---|---|---|---|---|---|
| 2,771,186 | A | | 11/1956 | Burbank | 206/58 |
| 3,193,427 | A | | 7/1965 | Rogers | 156/211 |
| 3,547,328 | A | | 12/1970 | Bjorklund | 225/49 |
| 3,628,692 | A | * | 12/1971 | Blatz | 221/70 |
| 4,346,830 | A | * | 8/1982 | Hauser | 225/49 |
| 4,371,104 | A | * | 2/1983 | Korte | 225/48 |
| 4,399,935 | A | | 8/1983 | Nelder | 225/49 |
| 4,426,029 | A | * | 1/1984 | Kamp | 225/49 |
| 4,506,816 | A | * | 3/1985 | Roccaforte | 225/48 |
| 4,648,537 | A | * | 3/1987 | Battig | 225/43 |
| 5,009,351 | A | * | 4/1991 | Handler | 225/52 |
| 5,082,159 | A | * | 1/1992 | Gutierrez | 225/34 |
| 5,226,571 | A | | 7/1993 | Eastwood et al. | 225/49 |
| 5,839,634 | A | * | 11/1998 | Pollard et al. | 225/39 |
| 5,947,360 | A | * | 9/1999 | Frank | 225/39 |
| 5,984,158 | A | * | 11/1999 | Frank | 225/48 |

OTHER PUBLICATIONS

"The Attacher" brochure, Ga–Vehren Engineering, 1993.
"Put Profit In The Bag" brochure, Ga–Vehren Engineering, 1997.

* cited by examiner

*Primary Examiner*—M. Rachuba
*Assistant Examiner*—Kim Ngoc Tran
(74) *Attorney, Agent, or Firm*—Boyle, Fredrickson, Newholm, Stein & Gratz, S.C.

(57) ABSTRACT

A paperboard carton for storing and dispensing a roll of web material, such as plastic film, foil, wax paper, etc. has a plastic (e.g., polystyrene) cutting blade that is adhered either to an inside surface of the front wall of the paperboard carton, or to an inside surface of the bottom wall of the paperboard carton. The polystyrene cutting blade preferably has a thickness of about 20/1000 of an inch, and preferably contains aggressive teeth at the ends of its serrated edge to help initiate tearing of the web material. The aggressive teeth are larger in size than the remaining teeth of the serrated edge. A slot is die-cut through the paperboard carton blank at the appropriate location in order to allow the serrated edge of the cutting blade to protrude through the slot and expose the teeth in a location suitable for tearing the web material. Use of the plastic or polystyrene cutting blade allows for increased production rates without compromising performance.

19 Claims, 7 Drawing Sheets

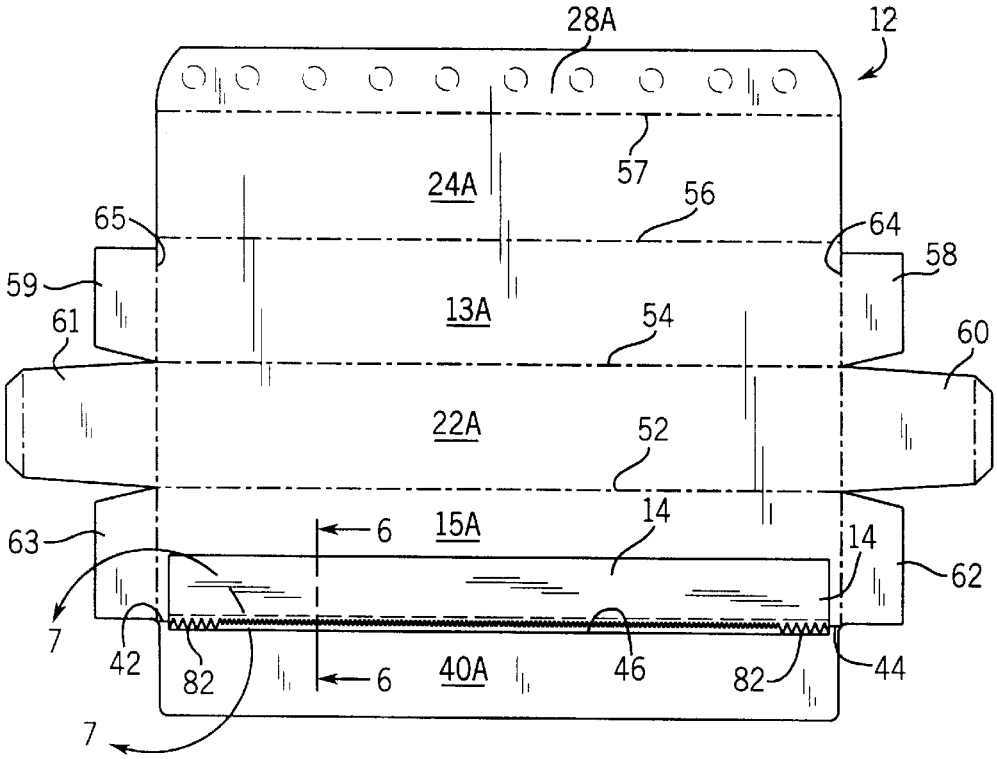
FIG. 5
FIG. 6
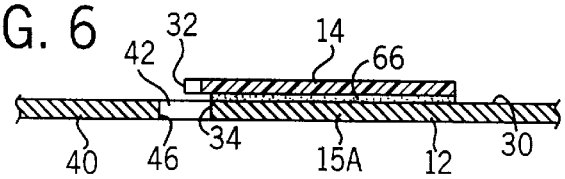
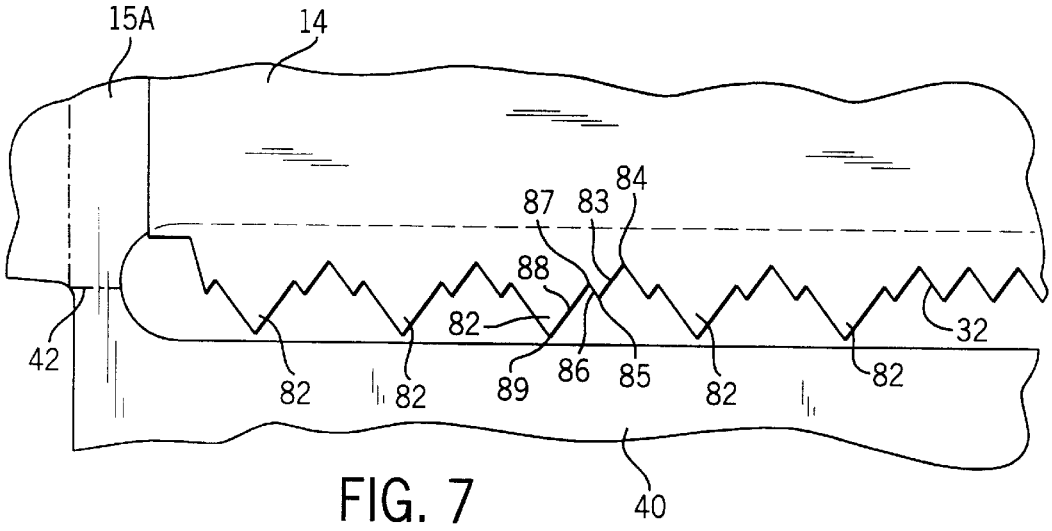
FIG. 7

PAPERBOARD DISPENSER CARTON WITH PLASTIC CUTTING BLADE ON CARTON BODY

FIELD OF THE INVENTION

The invention relates to the construction of paperboard cartons for dispensing rolls of plastic film, foil, wax paper, etc. More specifically, the invention relates to paperboard cartons having a plastic cutting blade (e.g. polystyrene), and methods of constructing such cartons and attaching the plastic cutting blades to such cartons.

BACKGROUND OF THE INVENTION

The invention was developed during ongoing developmental efforts by the Assignee of the present application to improve the manufacturing and performance of paperboard dispensing cartons having plastic cutting blades. Copending U.S. patent application Ser. No. 09/471,818, filed on Dec. 22, 1999 entitled "Paperboard Dispenser Carton with Plastic Cutting Blade", by Phillip L. Passamoni, incorporated herein by reference, is an example of a paperboard dispenser carton having a plastic cutting blade developed by the Assignee. As mentioned in the copending patent application, it is well know to dispense plastic film, wax paper, aluminum foil, and other rolls of film web material from a paperboard carton. Normally, paperboard cartons are formed from die-cut paperboard blanks that are glued and folded to form an elongated roll storage cavity. A lid is connected to the carton along a fold line between a back panel of the carton and the lid, such that the lid pivots about the fold line between an open position and a closed position. The lid normally has a front lip that nests adjacent a front panel of the carton when the carton is closed. Alternatively, the lid has a flap that folds inside the front panel to close the carton.

In most conventional paperboard cartons, a serrated metal cutting blade is provided to cut the film or foil. The metal cutting blade is typically attached on the outside surface of the front panel of the carton along the top edge of the front panel, although it is known in the art to attach the metal strip to the inside surface of the front lip on the lid, or on the outside surface of the bottom panel along the front edge of the bottom panel. In each of these arrangements, the serrated edge extends slightly beyond the paperboard panel to which it is attached, thus allowing the user to tear the web with the serrated edge.

The serrated metal cutting blades are typically attached to the paperboard carton by stamping the serrated metal blade onto the paperboard carton blank at a plurality of points. Such stamping techniques have been found much more reliable than adhesive, especially inasmuch as the width of the metal strips is typically about ⅜ of an inch and thus provides insufficient surface area for effective use of adhesive. In most current arrangements, the exposed serrated edge of the metal cutting blade is covered by a removable paperboard closing strip during shipment and handling. The removable paperboard closing strip is a removable extension of the front lip of the carton lid, which is attached along a perforation line. Removable paperboard closing strips are normally adhered to scored targets on the outside surface of the front panel of the carton, although other configurations are possible. The removable closing strips are removed in order to pen the carton for use.

The present invention, as well as the invention disclosed in the above incorporated copending patent application Ser. No. 09/471,818, was developed in an attempt to increase production speeds above those now possible for paperboard cartons using metal cutting blades. The use of plastic cutting blades not only increases production speeds, but the use of plastic cutting blades also simplifies the recycling of paperboard cartons. Metal cutting blades complicate pulping procedures when paperboard cartons are recycled in a batch along with other paper products. For example, it is normally necessary to remove metal cutting blades prior to or during the pulping process in order to protect recycling equipment. The use of plastic cutting blades eliminates this problem. Another advantage of using plastic cutting blades is that the plastic cutting blades are somewhat safer to handle during the manufacturing process, as well as for the end user. In addition, plastic cutting blades generate static when the web is torn and this helps the film stick to the front of the carton. Thus, making it is easier for the user to grab the web for the next tear. Many paperboard cartons using metal cutting blades use a small sticker on the front panel to accomplish the same result.

For the foregoing reasons, it is been found desirable to develop paperboard dispenser cartons having plastic cutting blades.

SUMMARY OF THE INVENTION

The invention is a paperboard carton that uses a plastic cutting blade mounted to an inside surface of a panel on the body of the carton. A serrated edge of the plastic cutting blade is exposed to facilitate tearing of a section of web material from a roll contained in the carton. Preferably, exposure of the serrated edge of the plastic cutting blade is accomplished by providing a longitudinal slot in the paperboard carton through which the serrated edge of the plastic cutting blade protrudes slightly. The cutting blade is preferably die cut from a sheet of polystyrene having a thickness of approximately $^{20}/_{1000}$ of an inch. Each end of the cutting blade preferably contains aggressive teeth, which are larger in size than the remaining teeth of the serrated edge, in order to help initiate tearing of the web material.

In one embodiment of the invention, the longitudinal plastic cutting blade is attached to an inside surface of the front wall of the container such that the serrated edge of the longitudinal cutting blade extends beyond an upper longitudinal edge of the front wall. In this embodiment, the carton preferably includes a longitudinal front flap which is connected to the front wall panel along a scored fold line. The longitudinal front flap folds inward and over the plastic cutting blade. A longitudinal slot is provided along the fold line at the upper longitudinal edge of the front wall. The serrated edge of the cutting blade protrudes through the longitudinal slot, thus allowing the serrated edge of the cutting blade to be exposed for tearing web material from the roll.

In another embodiment of the invention, a longitudinal slot is provided along the fold line between the bottom wall and the front wall of the carton. The longitudinal plastic cutting blade is attached to the inside surface of the bottom wall such that the serrated edge of the plastic cutting blade protrudes slightly through the slot so that the serrated edge is exposed along the lower front edge of the carton between the bottom wall and the front wall panel.

One of the primary advantages of the invention is that the plastic cutting blade can be securely applied to paperboard cartons at a much faster production rate (e.g. approximately 150 units per minute) than the stamped metal cutting blades of the prior art. The plastic cutting blade is preferably attached to the paperboard carton blanks using commercially available print finishing systems in which a feeding mechanism has been modified to accommodate feeding of the elongated plastic cutting blades. Hot melt adhesive is preferably used to secure the plastic cutting blade to the inside surface of the paperboard carton at the appropriate location. It has been found that the use of hot melt adhesive is particularly well suited for high production speeds. At reduced speeds, however, other means of adhering the plastic cutting blade to the paperboard carton may be suitable (e.g. heat sealing, ultrasonic sealing, providing pressure sensitive adhesive on the back of the cutting blade, etc). In order to assure adhesion of the plastic cutting blade to the inside surface of the carton, as well as assure the structural integrity of the plastic cutting blade, the width of the longitudinal cutting blade should be substantial, e.g., approximately 1 inch.

Other advantages and objects of the invention may be apparent to those skilled in the art upon inspecting the following drawings and description thereof.

BRIEF DESCRIPTION OF THE DRAWINGS

FIG. 5 is a plan view of a paperboard container blank which is die-cut and formed in order to manufacture the paperboard container shown in FIG. 3.

FIG. 6 is a detailed sectional view taken along line 6—6 in FIG. 5.

FIG. 7 is a detailed view of the area represented by arrow 7—7 in FIG. 5.

DETAILED DESCRIPTION OF THE DRAWINGS

First Embodiment

Figure 1:
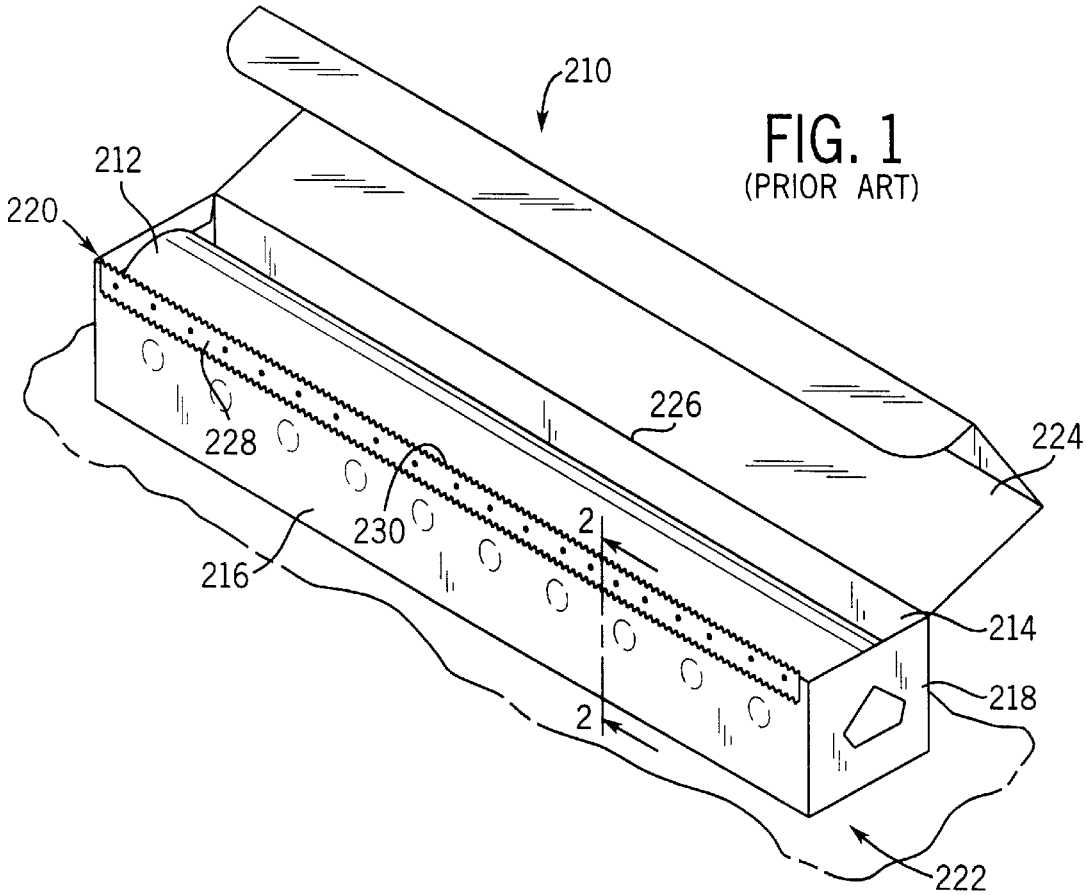
FIG. 1 (PRIOR ART)
FIG. 1 is a perspective view of a paperboard dispenser carton having a metal tear strip stamp attached along a longitudinal upper edge of the front wall of the carton in accordance with the prior art.
Figure 2:
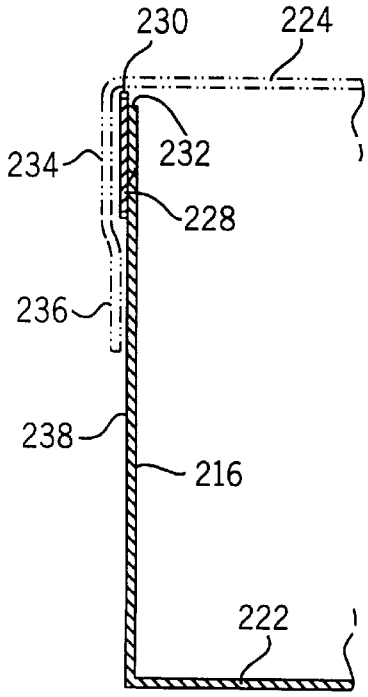
FIG. 2 (PRIOR ART)
FIG. 2 is a cross-sectional view of the prior art carton taken along line 2—2 in FIG. 1.

FIGS. 1 and 2 show a prior art paperboard carton 210 that stores and dispenses rolls 212 of plastic film, foil, wax paper, etc. The prior art paperboard carton 210 includes aback wall 214, a front wall 216, sidewalls 218, 220, and a bottom wall 222 which form a longitudinal cavity for storing the roll 212. The prior art carton 210 also includes a lid 224 that is pivotally attached to an upper portion of the rear wall 214 along fold line 226. The lid 224 is able to pivot between an open position (FIG. 1) and a closed position (FIG. 2).

In accordance with the prior art, a metal cutting blade 228 is attached to an outer surface of the front wall 216 of the carton 210. The metal cutting blade 228 includes a serrated edge 230 having teeth that are typically constant in size. The serrated edge 230 of the metal cutting blade 228 extends generally along the entire longitudinal length of the upper edge of the front wall 216, and is exposed slightly beyond the upper edge. The metal cutting blade 228 is attached along the front wall 216 by stamping the metal cutting blade 228 to the paperboard carton blank. This stamping is shown in detail in copending patent application Ser. No. 09/471, 818, entitled "Paperboard Dispenser Carton With Plastic Cutting Blade" by Phillip L. Passamoni, assigned to the assignee of the present invention, which is incorporated herein by reference. It is known in the art that this stamping technique fastens the metal cutting blade 228 to the front wall 216 in a secure manner that enables the cutting blade 228 to perform effectively over the course of the life of the paperboard carton 210.

FIG. 2 shows the prior art paperboard carton 210 in a closed position suitable for shipping and handling. In the closed position shown in FIG. 2, a front lip 234 of the carton is generally parallel and nested against an outside surface 238 of the front wall 216 of the carton 210. A lower portion 236 of the front lip is removably adhered to the outside surface 238 of the front wall 216 for shipping and handling. In order for the user to access the roll 212 within the carton 210, the lower portion 236 of the lip 234 is detached from the outer surface 238 of the front wall 216, and the lid 224 is opened. In order to dispense a panel of the roll material 212, the web 212 is unrolled with the tail of the web extending beyond the exposed serrated edge 230 of the metal cutting blade 228. Normally, the carton lid 224 is then placed in the closed position, although this is not necessary in all circumstances. Beginning at one end of the exposed serrated edge 230 of the metal cutting blade 228, the user pulls the web along the length of the blade 228 to tear a panel of web material from the roll 212. After the first use, it is common for the user to store the carton 212 with the front longitudinal lip 234 on the lid 224 tucked inside of the front wall 216 between the front wall 216 and the roll 212.

As mentioned, the lower portion 236 of the front longitudinal lip 234 is removably attached to the outside surface 238 of the front wall 216 for shipping and handling. This is typically accomplished by applying spots of adhesive to the lower portion of the outer surface 238 of the front wall 216 at cut-scored targets 240. When the front lip 234, 236 is detached from the outside surface 238 of the front wall 216, the top layers of paper for the cut-scored targets 240 are removed with the front longitudinal lip 234, 236.

Figure 3:
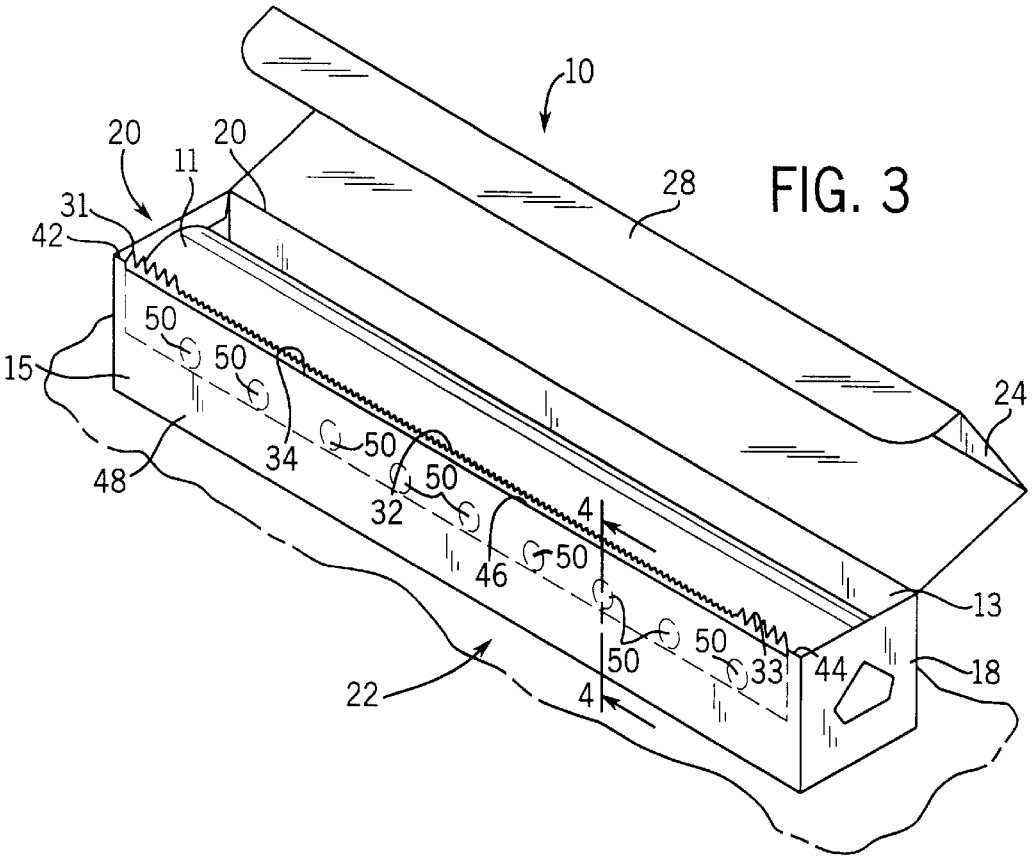
FIG. 3 is a perspective view of a paperboard carton having a plastic cutting blade adhered to the front wall of the carton in accordance with a preferred embodiment of the invention.
Figure 4:
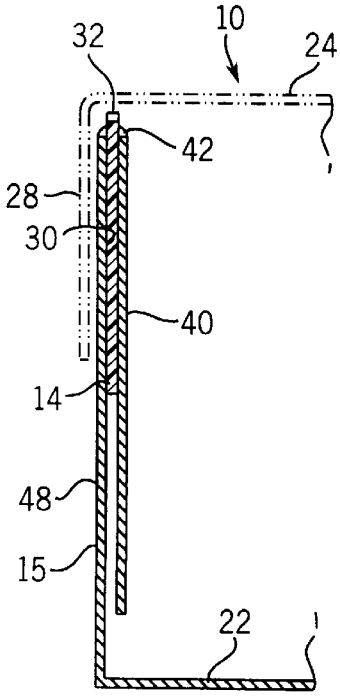
FIG. 4 is a cross-sectional view taken along line 4—4 in FIG. 3.
Figure 8:
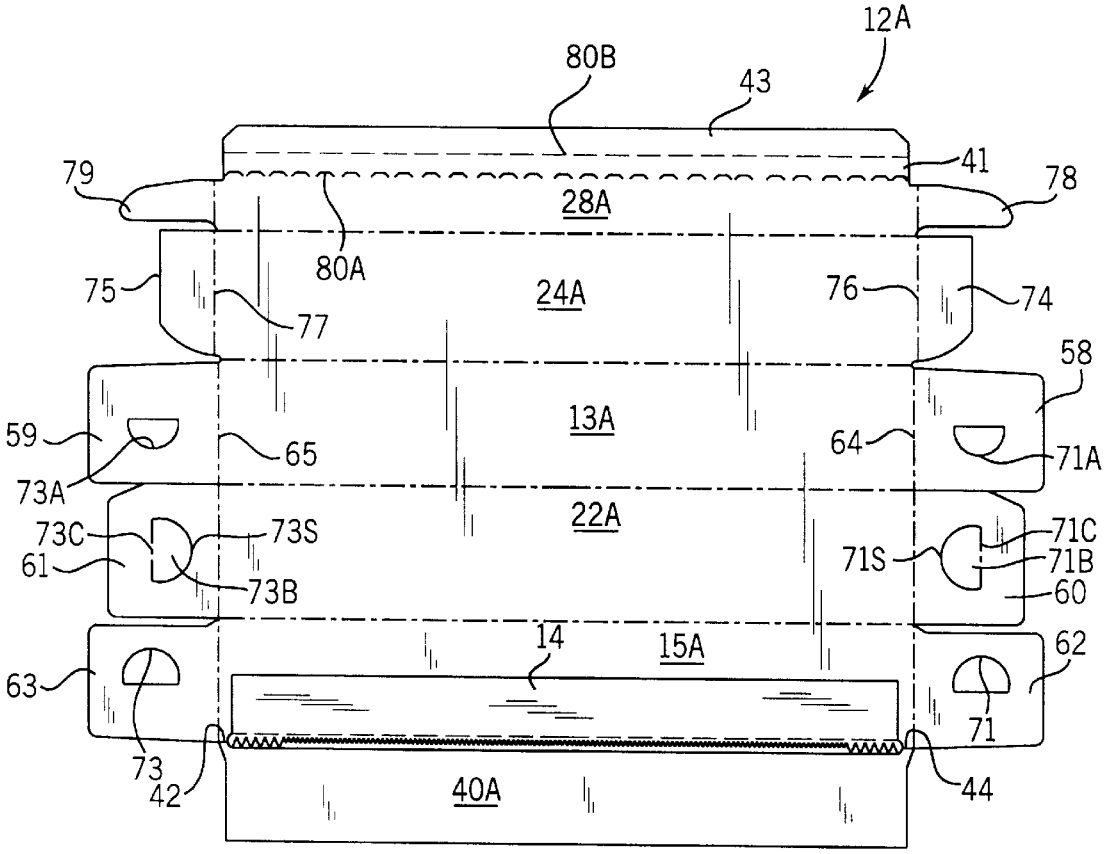
FIG. 8 is a plan view of a paperboard carton blank similar to that shown in FIG. 5, except that it provides for reinforcement flaps and a longitudinal attachment strip for the lip of the carton lid.
Figure 17:
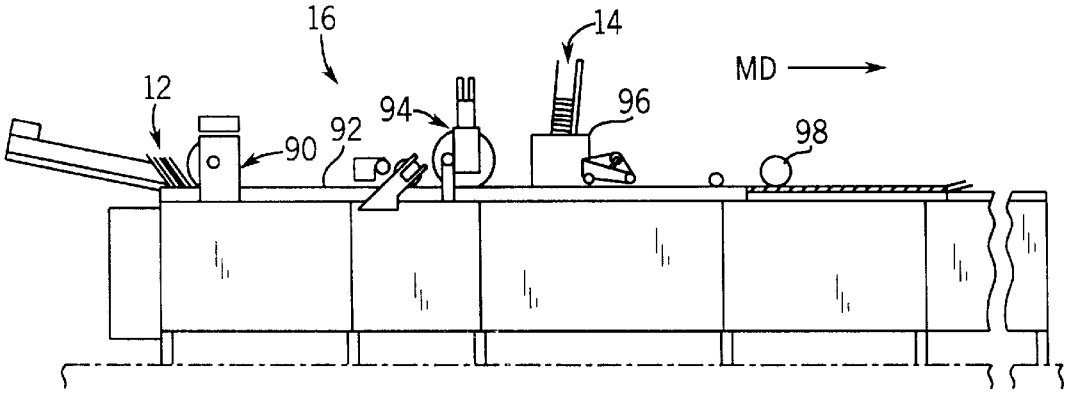
FIG. 17 is a schematic view of a finishing machine that applies adhesive to the paperboard carton blanks and adheres the plastic cutting blades thereto.

FIGS. 3 and 4 show a paperboard carton 10 constructed in accordance with the first embodiment of the invention. FIGS. 5–7 illustrate a die-cut paperboard carton blank 12 and a polystyrene cutting blade 14 used to fabricate the paperboard carton 10 shown in FIGS. 3 and 4. FIG. 8 illustrates another version of a die-cut paperboard carton blank 12*a* in accordance with the first embodiment of the invention. FIG. 17 schematically illustrates a finishing machine 16 that attaches the polystyrene cutting blades 14 to the paperboard carton blanks 12 using hot melt adhesive.

A paperboard carton 10 constructed in accordance with the first embodiment of the invention stores and dispenses rolls of plastic film, aluminum foil, wax paper, etc., and generally implements the same functions of the prior art paperboard carton 210 illustrated in FIGS. 1 and 2. The paperboard carton 10 includes a back wall 13, a front wall 15, sidewalls 18, 20, and a bottom wall 22 which collectively form a longitudinal cavity for storing the roll 11. The paperboard carton 10 also includes a lid 24 that is pivotally attached to an upper portion of the rear wall 13 along fold line 26. The lid 24 is able to pivot between an open position (FIG. 3) and a closed position (FIG. 4). The lid 24 has a longitudinal front lip 28. FIG. 4 shows the lid 24 in a closed position for shipping and handling. The lip 28 may be tucked inside of the front wall 15 in order to close the carton after use.

In accordance with the invention, a plastic cutting blade 14, preferably a polystyrene cutting blade, is attached to an inside surface of the front wall 15 of the carton 10. The polystyrene cutting blade 14 includes a serrated edge 32 having teeth that have constant size except at the ends 31, 33. The ends 31, 33 of the serrated edge 32 of the polystyrene cutting blade 14 contain aggressive teeth having exaggerated size in order to promote the initiation of tearing of the web material. The serrated edge 32 of the polystyrene cutting blade 14 extends generally along the length of the upper edge 34 of the front wall 15 of the carton, and is exposed slightly beyond the upper edge 34 of the front wall 15. The polystyrene cutting blade 14 is preferably attached along the inside surface 30 of the front wall 15 using permanent adhesive such as hot melt adhesive. As previously mentioned, various alternatives to hot melt adhesive such as heat sealing, ultrasonic sealing, pressure-sensitive adhesive with release liner, etc. may be used to attach the polystyrene cutting blade 14 to the inside surface 30 of the front wall 15. The polystyrene cutting blade 14 preferably has a thickness of about $^{20}/_{1000}$ of an inch. In contrast to the metal cutting blades 228 of the prior art, the polystyrene cutting blade 14 preferably has a width of about one inch. This is desirable in order to ensure that the hot melt adhesive fastens the cutting blade 14 to the front wall 15 in a secure manner over the course of the entire life of the paperboard carton 10. In this regard, it is desirable that the polystyrene cutting blade 14 have a height sufficient to extend from the upper edge 32 of the front wall 15 downward for about one inch or more along the inner surface 30 of the front wall 15. It has been found that sizing the polystyrene cutting blade 14 as such provides sufficient rigidity to the cutting blade 14 and the serrated edge 32, in order to optimize performance of the cutting blade 14.

In its preferred form, the carton 10 includes a longitudinal front wall reinforcement flap 40. The longitudinal front flap 40 is hingedly attached to the upper longitudinal edge 34 (FIG. 3) of the front wall 15. The longitudinal front flap 40 folds inward and over the serrated edge 32 of the plastic cutting blade 14. A longitudinal slot 46 is provided along the fold line at hinge locations 42, 44. Hinge 42 is located between the front wall 15 and the flap 40 at a first hinge location adjacent the first end 31 of the longitudinal plastic cutting blade 14. Hinge 44 between the front wall and the flap 40 is located at a second hinge location adjacent the second end 33 of the serrated edge 32 of the longitudinal cutting blade 14. The longitudinal slot 46 extends between the first 42 and second 44 hinge locations. The serrated edge 32 of the plastic cutting blade 14 protrudes through the longitudinal slot 46 and extends slightly beyond the upper edge 46 of the front wall 15. It may be desirable to adhere the front flap 40 to the plastic cutting blade 14 in order to improve strength, although this is not strictly necessary and may not be desirable.

In use, the roll 11 is unrolled so that a desired amount of web material extends beyond the serrated edge 32 of the polystyrene cutting blade 14. The user pulls the unrolled web material against the cutting blade 14 beginning at one of the ends 31, 33 of the serrated edge 32 in order to tear a panel of web material from the roll 11.

When the carton 10 is in a closed position prior to usage, the front lip 28 of the lid 24 is removably attached to the outside surface 48 of the front wall 15. The front wall 15 contains cut-scored targets 50 for spot placed adhesive. The lip 28 is attached with adhesive to the cut-scored targets 50 and covers the serrated edge 32 during shipment and handling. When the lip 28 is originally opened for use of the roll 11 within the carton 10, the outer paper layer of the cut-scored targets 50 on the outer surface 48 of the front wall 50 delaminates and is removed from the front wall with the lip 28.

Referring to FIGS. 5–7, the paperboard carton blank 12 is die-cut into the form shown in FIG. 5, and includes several scored fold lines. The paperboard blank 12 is made of conventional paperboard having a smooth side and a rough side. The blank 12 has several elongated, rectangular portions 15*a*, 22*a*, 13*a*, 24*a*, 40*a*, and a front lip portion 28*a*. The elongated, rectangular portion 15*a* corresponds to the front wall 15 of the carton. A fold line 52 separates the front wall portion 15*a* from elongated, rectangular portion 22*a* which corresponds to the bottom wall 22 of the carton. Fold line 54 separates the bottom wall portion 22*a* from the elongated, rectangular portion 13*a* which corresponds to the back wall 13 of the carton. Fold line 56 separates the back wall portion 13*a* from the elongated, rectangular portion 24*a* which corresponds to the top of the lid 24. Fold line 57 separates the top lid portion 24*a* from the front lip portion 28*a*. Slot 46 between hinges 42 and 44 separates the front wall portion 15*a* from the front flap portion 40*a*. The fold lines 52, 54, 56, 57 and the longitudinal slot 46 are each parallel to one another.

The carton blank 12 also includes sidewall portions 58, 59, 60, 61, 62, 63. In this regard, fold lines 64 and 65 are perpendicular to fold lines 52, 54 and 56. Fold line 64 separates front wall portion 15*a* from sidewall portion 62, bottom wall portion 22*a* from sidewall portion 60, and back wall portion 13*a* from sidewall portion 58. In a similar manner, fold line 65 separates front wall portion 15*a* from sidewall portion 63, bottom wall portion 22*a* from sidewall portion 61, and back wall portion 13 from sidewall portion 59. Slits are provided between adjacent sidewall portions to allow the sidewall portions to fold upon assembly. In addition, it may be desirable to die-cut ears/ear access windows in the sidewall portion as discussed in above-incorporated U.S. patent application Ser. No. 09/471,818. When the paperboard carton blank 12 is folded into a carton 10, the sidewall portions 58, 59, 60, 61, 62, 63 are folded along the respective fold line 64, 65, and overlap one another.

As illustrated in FIGS. 6 and 7, the polystyrene cutting blade 14 is attached to the inside surface of front wall portion 15*a*. Preferably, the polystyrene cutting blades 14 are adhered to the inside surface 30 of the front wall portion 15*a* using hot melt adhesive 66, and in such a manner so that the serrated edge 32 extends slightly beyond the edge 34 of the front wall portion 15*a* and hangs over the slot 46. In this manner, the serrated edge 32 of the cutting blade 14 is exposed for use when the flap 40 is folded over the serrated edge 32 of the cutting blade 14.

The polystyrene cutting blades 14 can be die-cut from rectangular polystyrene blanks. The serrated edge of the polystyrene cutting blade 14 includes a plurality of teeth, which along the central portion of the blade preferably have constant size (e.g., approximately ⅙ of an inch from peak to valley). However, aggressive teeth 82 are located at the ends 31, 33 of the blade 14. The aggressive teeth 82 are substantially larger in size than the centrally located teeth. Preferably, there are five aggressive teeth located at each end 31, 33 of the blade 14. The aggressive teeth 82 are preferably symmetrical in nature. The preferred profile (FIG. 7) of the aggressive teeth 82 includes a first protruding section 83 extending between a base valley 84 and an intermediate peak 85, a receding section 86 extending between the intermediate peak 85 and an intermediate valley 87, and another protruding section 88 extending from the intermediate valley 87 to the ultimate peak 89. It has been found that this tooth geometry is particularly effective for initiating the tearing of plastic webs along the cutting blade 14, although other tooth geometries may be effective as well. It has been found that the use of five or more aggressive teeth at each end 31, 33 of the blade 14 are desirable in order to ensure that the web catches the aggressive teeth upon initiation of the tearing of the web material.

FIG. 8 shows an alternative version 12*a* of a paperboard carton blank configured in accordance with the first embodiment of the invention. The paperboard carton blank 12*a* includes a removable cover strip 41 which is removably attached to the front lip portion 28*a*. The blank 12*a* also includes a longitudinal attachment strip 43. When the carton 12*a* is in use, the longitudinal attachment strip 43 is permanently attached to the outside surface 48 of the front wall 15 of the carton 10. The longitudinal attachment strip 43 is attached to the front wall 15, preferably with a continuous line of glue. In the blank 12*a* shown in FIG. 8, a removable cover strip 41 is defined between a first perforated longitudinal tear line 80*a* and a second perforated longitudinal tear line 80*b*. The removable cover strip 41 is not attached directly to the outer surface of the carton, however, the lid 28 is fixed in a closed position suitable for shipping and handling until the removable cover strip 41 is removed. One of the primary advantages of the version 12*a* shown in FIG. 8 over the version 12 shown in FIG. 5 is that glue can be applied to the back of the longitudinal attachment strip 43 as a continuous line, rather than applying spots of glue only at targets 50 as in the earlier version 12.

The blank 12*a* also includes lid sidewall portions 74, 75 and attachment flaps 78, 79. Lid sidewall portions 74, 75 are separated from the top lid portion 24*a* along fold line 76, 77, respectively. The attachment flaps 78, 79 are separated from the front lip portion 28*a* of the lid also by fold line 76, 77, respectively. In this version 12*a*, the attachment flap 78, 79 are secured to the lid sidewall portions 74, 75, respectively, with hot melt adhesive during the fabrication process so that the front lip 28*a* is fixed in a position substantially perpendicular to the top of the lid 24*a*.

The version 12*a* also explicitly shows a construction for providing roll retaining ears in the sidewalls of the carton. In particular, sidewall portions 62, 63 adjacent the front wall portion 15*a* each have an ear access window 71, 73 die-cut therein. In a similar manner, sidewall portions 58, 59 adjacent the back wall portion 13*a* each have ear access windows 71*a*, 73*a* die-cut therein. The sidewall portions 60, 61 adjacent the bottom wall portion 22*a* have roll retaining ears 71*b*, 73*b*. The ears 71*b*, 73*b* are formed by providing a fold line 71*c*, 73*c* and semi-circular slits 71*s*, 73*s* in the respective sidewall portions 60, 61. The windows 71, 71*a*, 73, 73*a* for the roll retaining ears 71*b*, 73*b* are sized so that the ears can fold inwardly into the longitudinal cavity containing the roll 11 when the carton is in use.

Referring to FIG. 17, the polystyrene cutting blades 14 can be attached to the paperboard carton blanks 12, 12*a* in an efficient manner using a finishing machine 16 as shown in FIG. 17. The machine 16 shown in FIG. 17 is a commercially available print finishing system in which the feeding mechanism has been modified to accommodate feeding of the elongated plastic cutting blades 14. The paperboard carton blanks 12, 12*a* are fed into the system by a vacuum feed wheel 90. The paperboard carton blanks 12, 12*a* are then aligned in an alignment section 92 and fed to a gluer 94 which applies hot melt adhesive to the paperboard carton blanks in a specified pattern. The polystyrene cutting blades 14 are introduced into the system by a feeder 96 that places the blade over hot melt adhesive in the appropriate location on the paperboard carton blank 12, 12*a*. A pressure cylinder 98 applies pressure to ensure that the cutting blades 14 are secured to the paperboard carton blanks 12, 12*a*. The paperboard carton blanks 12, 12*a* with the adhesive applied thereto and the cutting blades 14 applied thereto are then folded and formed downstream in order to form a collapsed carton, as is known in the art. The throughput of finishing machine 16 is approximately 150 units per minute, which is a substantial increase over the prior art systems.

Second Embodiment

Figure 9:
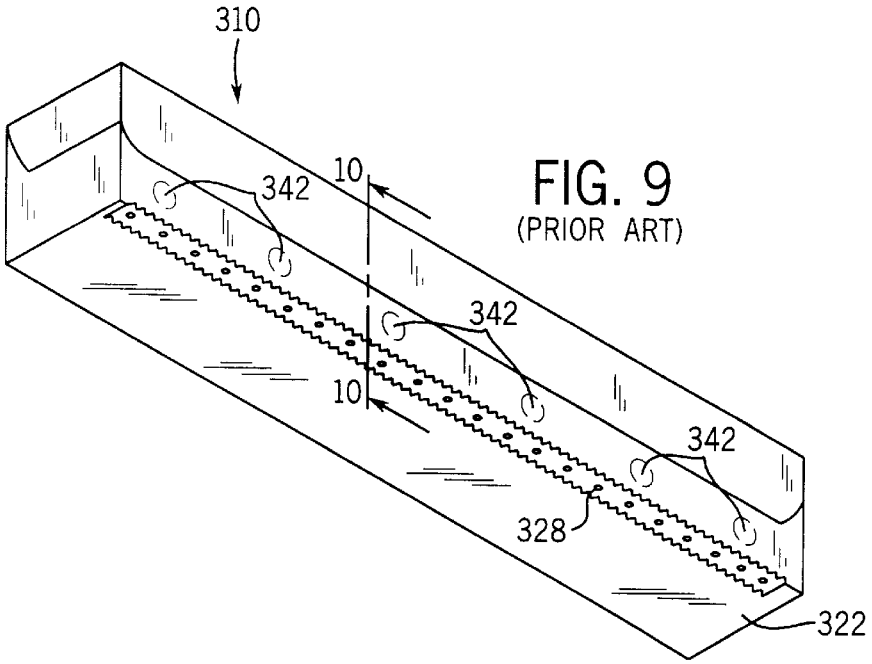
FIG. 9 (PRIOR ART)
FIG. 9 is a perspective view of a paperboard carton having a metal tear strip stamp attached to the bottom wall along the lower front edge in accordance with the prior art.
Figure 10:
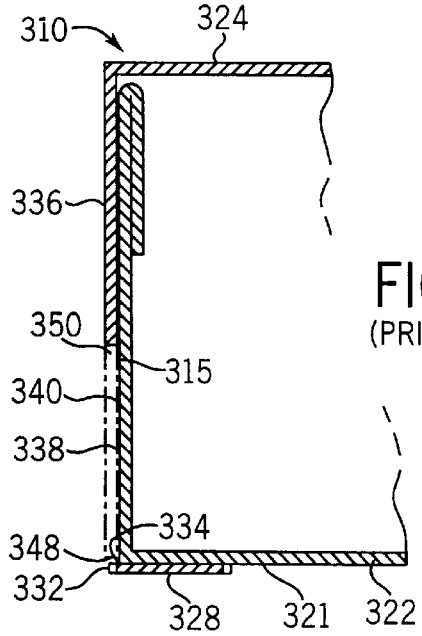
FIG. 10 (PRIOR ART)
FIG. 10 is a detailed sectional view taken along line 10—10 in FIG. 9, also showing this prior art configuration in detail.
Figure 11:
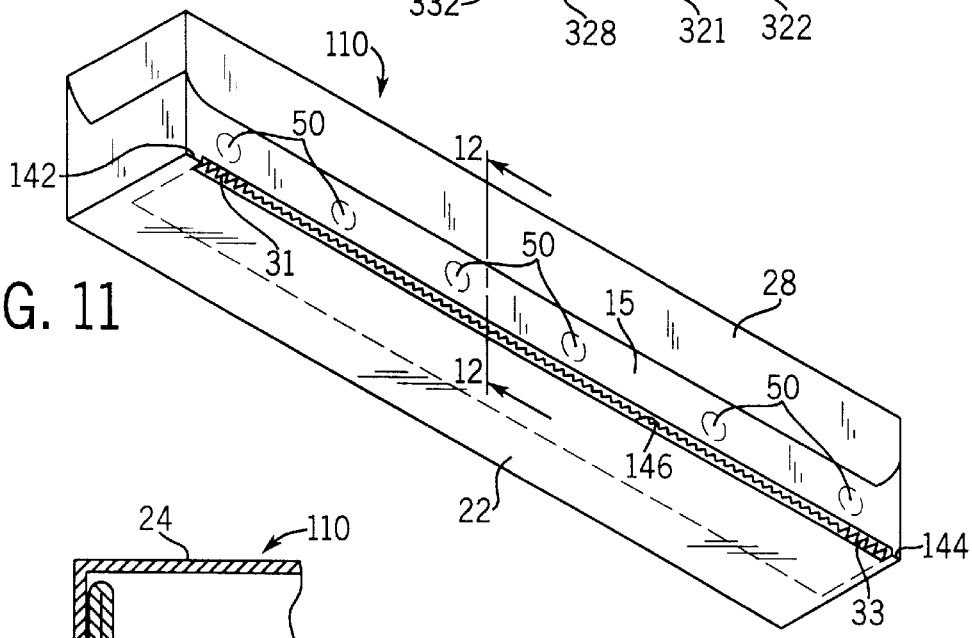
FIG. 11 is a perspective view of a paperboard carton having a plastic tear strip in accordance with another embodiment of the invention.

FIGS. 9 and 10 show a prior art paperboard carton 310 that stores and dispenses rolls of plastic film, foil, wax paper, etc. In many respects, the prior art paperboard carton 310 shown in FIGS. 9 and 10 is similar to the prior art paperboard carton 210 shown in FIGS. 1 and 2. The primary difference between the two prior art designs is that the prior art paperboard carton 310 shown in FIGS. 9 and 10 includes a metal cutting blade 328 that is attached to an outer surface 321 of the bottom wall 322 of the carton 310, rather than along the top edge of the front wall of the carton. In other respects, the prior art paperboard carton 310 is generally similar to the prior art paperboard carton 210 shown in FIGS. 1 and 2.

Referring in particular to prior art FIG. 10, the metal cutting blade 328 is attached to the outer surface 321 of the bottom wall 22, such that a serrated edge 332 of the blade 328 extends essentially along the entire longitudinal length of the lower front edge 334 of the carton 310. Note that the metal cutting blade 328 is attached by stamping the metal cutting blade to the paperboard carton in accordance with prior art methods. The serrated edge 332 of the metal cutting blade 338 extends slightly beyond the plane of the front wall 315 in order to facilitate its use in tearing the web material. The prior art paperboard carton 310 includes a front lip on the lid 324, which includes removable strip 338 shown in phantom in FIG. 10. The removable strip 338 is typically removably attached to the outside surface 340 of the front wall 315 using adhesive applied to die-scored targets 342 (FIG. 9). The removable strip 338 is attached to the lid lip 336 along a perforation line 350 (FIG. 10). Preferably, the removable strip 338 extends downward so that its lower edge 348 abuts the serrated edge 332 of the metal cutting blade 328 mounted to the outside surface 321 of the bottom wall 322. In this manner, the removable strip 338 (shown in phantom in FIG. 10) provides limited protection during shipping and handling.

FIGS. 11–16 illustrate a paperboard carton 110 and carton blank 110*a* in accordance with a second embodiment of the invention. In many respects, the carton 110 is similar to that shown in FIGS. 3–8. The primary difference being that the cutting blade 14 in the second embodiment 110 is attached to an inside surface 121 of the bottom wall 22 of the carton, rather than to an inside surface of the front wall 15. Therefore, similar reference numbers are used where appropriate in order to avoid redundancy.

Importantly, the carton 110 includes a longitudinal slot 146 at the intersection between the front wall 15 and the bottom wall 22. The serrated edge 32 of the cutting blade 14 protrudes through the longitudinal slot 146. The slot 146 extends between fold locations 142 and 144. The construction of the cutting blade 14 is preferably the same as discussed above with respect to the plastic cutting blade 14 of the first embodiment of the invention.

Figure 13:
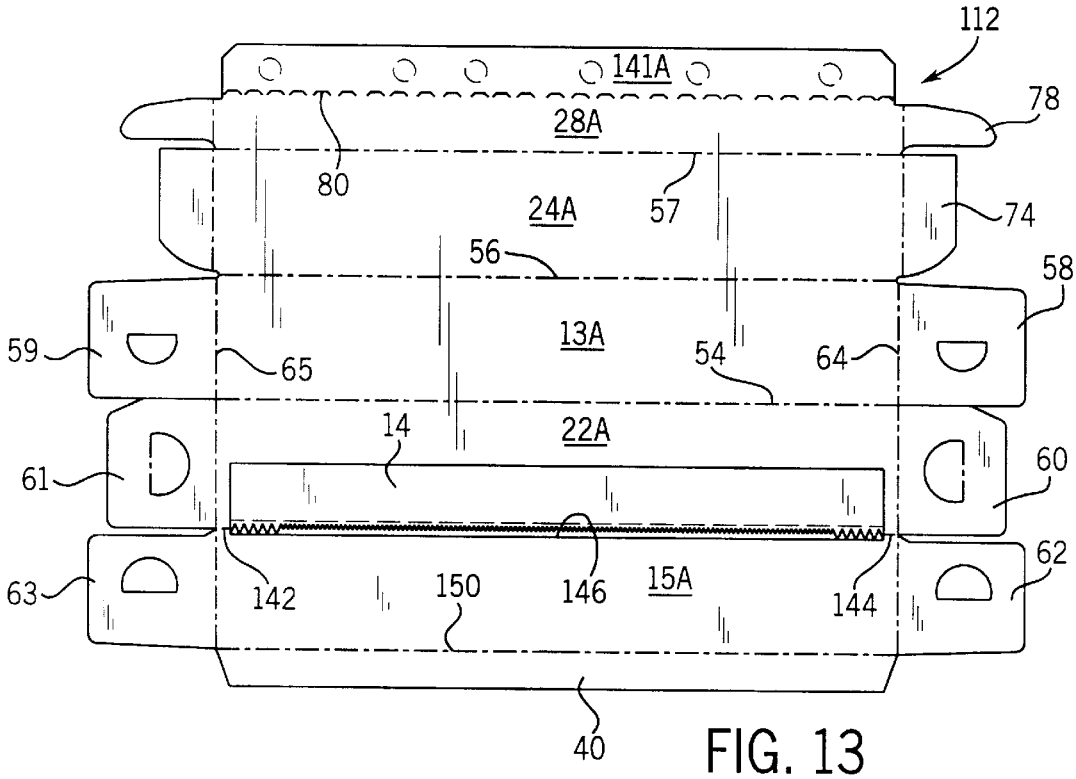
FIG. 13 is a plan view of a paperboard container blank which is die-cut and formed in order to manufacture the paperboard container of FIG. 11.

Referring in particular to FIG. 13, the paperboard blank 112 is somewhat different for the second embodiment 110 than the first embodiment 12, 12*a* (FIGS. 3–8). In the second embodiment 112, the longitudinal slot 146 is located between the bottom wall portion 22*a* and the front wall portion 15*a*. In addition, fold line 150 is provided between flap 40 and front wall portion 15*a*. Further, removable strip 141*a* is connected to the lip portion 28*a* of the lid along perforated tear line 80. Otherwise, the configuration of the paperboard blank 110*a* and its use in construction of a paperboard carton 110 is generally similar to that described in accordance with the first embodiment of the invention, namely FIGS. 3–8.

Figure 12:
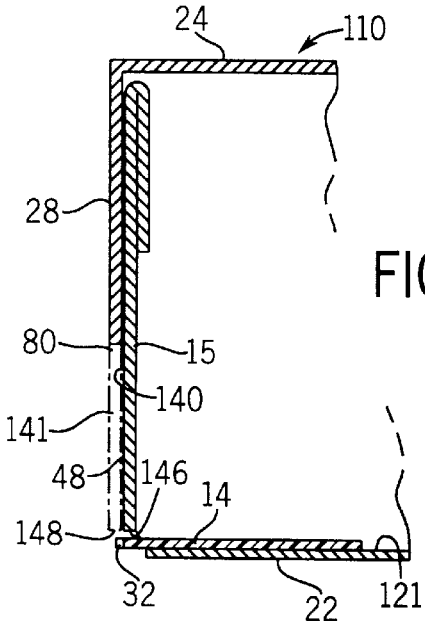
FIG. 12 is a detailed sectional view taken along line 12—12 in FIG. 11.
Figure 14:
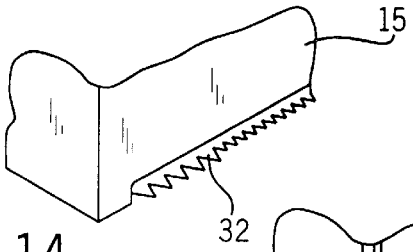
FIGS. 14, 15 and 16 are detailed views illustrating a lower front edge of the paperboard container shown in FIG. 11.
Figure 15:
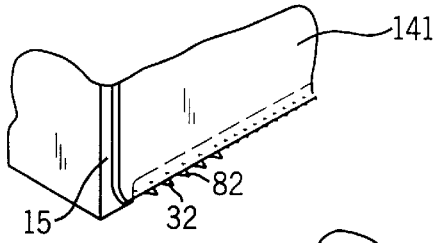
Figure 16:
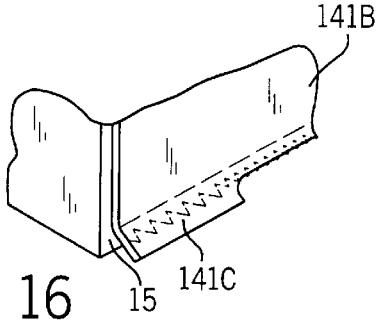

In the second embodiment of the invention 110, a closing strip 141 is a removable extension of the front lip 28 (see FIG. 12). The removable closing strip 141 is sized so that the bottom edge 148 of the strip 141 is adjacent the serrated edge 32 of the cutting blade when the removable strip 141 is adhered to the outside surface 140 of the front wall 15 for shipping and handling. When the removable strip 141 is removed to allow opening of the carton 110, the serrated edge 32 of the cutting blade 14 is exposed in order to facilitate tearing of the web material, as shown in FIG. 14. Before the removable strip 141 is removed, the strip at least partially limits exposure of the serrated edge 238, as shown in FIG. 15. In the configuration shown in FIG. 15, the aggressive teeth 82 on the cutting blade having exaggerated size may protrude beyond the outer surface of the removable strip 141. If this is not desirable, the removable closing strip 141 can be modified as shown in FIG. 16. In FIG. 16, the removable closing strip 141*b* includes a small flap 141*c* designed to cover the aggressive teeth 82 prior to removal of the closing strip 141*b*.

While the invention has been described in connection with various embodiments, various other and alternatives are contemplated as being within the scope of the following claims which particularly point out and distinctly claim the subject matter regarded as the invention.

I claim:

1. A paperboard carton for storing and dispensing a roll of web material, the carton comprising:

a back wall, a front wall and a first side wall and a second side wall defining a longitudinal roll storage container;

a longitudinal lid that is pivotally connected to a top edge of the back wall along a lid fold line, the longitudinal lid comprising a longitudinal top wall, and a front longitudinal lip, the front longitudinal lip being connected to the longitudinal top wall of the lid along a lip fold line and directed downward so that the lip is located substantially adjacent an upper portion of the front wall of the longitudinal roll storage container when the carton is closed;

a longitudinal plastic cutting blade having a serrated edge, the plastic cutting blade being attached to an inside surface of the front wall of the longitudinal roll storage container such that the serrated edge of the longitudinal plastic cutting blade extends beyond an upper longitudinal edge of the front wall; and a longitudinal front flap that is hingedly attached to the upper longitudinal edge of the front wall, the flap being attached to the upper longitudinal edge of the front wall at a first hinge location adjacent a first end of the longitudinal plastic cutting blade and at a second hinge location adjacent a second end of the longitudinal plastic cutting blade, wherein the serrated edge of the longitudinal plastic cutting blade protrudes through a longitudinal slot in the paperboard carton extending between the first and second hinge locations.

2. A paperboard carton as recited in claim 1 wherein the carton further comprises:

a removable paperboard closing strip connected to the longitudinal lip on the lid along a perforated tear line that is substantially parallel to the lip fold line.

3. A paperboard carton as recited in claim 2 wherein an inside surface of the removable closing strip is adhered to cut-scored targets on a lower portion of the outer surface of the front wall of the longitudinal roll storage container such that an outer layer of paper is delaminated and removed from the cut-scored targets when the closing strip is removed.

4. A paperboard carton as recited in claim 2 wherein the perforated longitudinal tear line is the first perforated longitudinal tear line and the carton further comprises:

a longitudinal attachment strip;

a second perforated longitudinal tear line that is substantially parallel to the first perforated longitudinal tear line and separates the removable closing strip from the longitudinal attachment strip, the removable closing strip being defined between the first and second perforated longitudinal tear lines;

wherein the longitudinal attachment strip is adhesively attached to a lower portion of the outer surface of the front wall of the longitudinal roll storage container.

5. A paperboard carton as recited in claim 4 wherein glue is applied to the back side of the longitudinal attachment strip in a continuous line in order to attach the attachment strip to the lower portion of the outer surface of the front wall of the longitudinal roll storage container.

6. A paperboard carton as recited in claim 1 wherein the plastic cutting blade is a polystyrene cutting blade that is die cut from a sheet of polystyrene having a thickness of about $^{20}/_{1000}$ of an inch.

7. A paperboard carton as recited in claim 1 wherein the elongated cutting blade is attached to an inside surface of the longitudinal front wall of the carton using hot melt adhesive.

8. A paperboard carton as recited in claim 1 wherein the serrated edge of the plastic tear strip contains aggressive teeth at the ends of the serrated edge to help initiate tearing of the web material, the aggressive teeth being larger in size than the remaining teeth of the serrated edge.

9. A paperboard carton as recited in claim 8 wherein the plastic cutting blade contains five aggressive teeth at each end of the serrated edge.

10. A paperboard carton as recited in claim 1 wherein the longitudinal lip is securely attached to the lid with reinforcement flaps so that the longitudinal lip is directed substantially parallel with the front wall of the longitudinal roll storage container and located adjacent an upper portion of the front wall of the longitudinal roll storage container when the carton is closed.

11. A paperboard carton for storing and dispensing a roll of web material, the carton comprising;

a back wall, a bottom wall, a front wall, and a first side wall and a second side wall defining a longitudinal roll storage container;

a longitudinal lid that is pivotally connected to a top edge of the back wall along a lid fold line, the longitudinal lid comprising a longitudinal top wall and a longitudinal front lip, the front longitudinal lip being connected to the longitudinal top wall of the lid along a lip fold line and directed downward so that the lip is located substantially adjacent an upper portion of an outer surface of the front wall of the longitudinal roll storage container when the carton is closed;

a front longitudinal fold line between the bottom wall and the front wall;

a longitudinal cutting blade slot along the front longitudinal fold line; and a longitudinal plastic cutting blade having a serrated edge, the plastic cutting blade being attached to an inside surface of the bottom wall of the longitudinal roll storage container such that the serrated edge of the longitudinal plastic cutting blade protrudes through the longitudinal slot in the paperboard carton.

12. A paperboard carton as recited in claim 11 wherein the carton further comprises:

a removable closing strip being connected to the longitudinal lip on the lid along a perforated tear line that is substantially parallel to the lip fold line.

13. A paperboard carton as recited in claim 12 wherein:

an outer surface of the front wall of the carton includes a plurality of cut-scored targets; and the removable closing strip is adhered with spot applied adhesive to the cut scored targets on the outer surface of the front wall.

14. A paperboard carton as recited in claim 12 wherein the removable closing strip has a lower longitudinal edge which is located adjacent the plastic cutting blade protruding through the slot along the front longitudinal fold line.

15. A paperboard carton as recited in claim 11 wherein the plastic cutting blade is a polystyrene blade.

16. A paperboard carton as recited in claim 15 wherein the polystyrene cutting blade is die cut from a sheet of polystyrene having a thickness of about $^{20}/_{1000}$ of an inch.

17. A paperboard carton as recited in claim 11 wherein the elongated plastic cutting blade is attached to the inside surface of the bottom wall using hot melt adhesive.

18. A paperboard carton as recited in claim 11 wherein the serrated edge of the plastic cutting blade contains aggressive teeth at the ends of the serrated edge to help initiate tearing of the web material, the aggressive teeth being larger in size than the remaining teeth of the serrated edge.

19. A paperboard carton as recited in claim 18 wherein the plastic cutting blade contains five aggressive teeth at each end of the serrated edge.

* * * * *